US008776804B2

(12) United States Patent
Zeanah et al.

(10) Patent No.: US 8,776,804 B2
(45) Date of Patent: Jul. 15, 2014

(54) LITTER DISPOSAL DEVICE

(75) Inventors: Eric L. Zeanah, Knoxville, TN (US); Wilmer Odom, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 1963 days.

(21) Appl. No.: 11/452,993

(22) Filed: Jun. 15, 2006

(65) Prior Publication Data

US 2007/0107741 A1 May 17, 2007

Related U.S. Application Data

(60) Provisional application No. 60/692,379, filed on Jun. 21, 2005.

(51) Int. Cl.

| | |
|---|---|
| ***A24F 15/08*** | (2006.01) |
| ***A24F 15/18*** | (2006.01) |
| ***A24F 19/00*** | (2006.01) |
| ***A24F 19/10*** | (2006.01) |

(52) U.S. Cl.

USPC ..... 131/242; 131/237; 131/231; 131/238; 131/256; 131/236

(58) Field of Classification Search

None

See application file for complete search history.

(56) References Cited

U.S. PATENT DOCUMENTS

| | | | | |
|---|---|---|---|---|
| 3,477,444 | A * | 11/1969 | Adams et al. | 131/235.1 |
| 3,888,264 | A | 6/1975 | Baclit | |
| 4,052,179 | A * | 10/1977 | Kirk | 96/139 |
| RE31,076 | E | 11/1982 | Herman | |
| 4,809,715 | A * | 3/1989 | Musetti | 131/256 |
| 4,961,496 | A | 10/1990 | Focke et al. | |
| 5,368,155 | A | 11/1994 | Ewen | |
| 5,673,709 | A | 10/1997 | Brothers | |
| 5,711,423 | A | 1/1998 | Fuller, Jr. | |
| 5,799,781 | A | 9/1998 | Arthur | |
| 5,848,595 | A | 12/1998 | Arthur | |
| 5,918,736 | A | 7/1999 | Suzuki et al. | |
| 6,604,530 | B1 | 8/2003 | Rogari et al. | |
| 6,606,996 | B1 | 8/2003 | Thornell et al. | |
| 6,843,255 | B2 | 1/2005 | Thornell et al. | |
| 7,055,714 | B2 | 6/2006 | Perelli et al. | |
| 7,077,059 | B1 | 7/2006 | Cobb | |
| 2005/0072841 | A1 | 4/2005 | Price et al. | |
| 2005/0236282 | A1 | 10/2005 | Huska | |
| 2005/0274389 | A1 | 12/2005 | Keller | |
| 2006/0000725 | A1 | 1/2006 | King | |

* cited by examiner

*Primary Examiner* — Richard Crispino
*Assistant Examiner* — Phu Nguyen
(74) *Attorney, Agent, or Firm* — Buchanan Ingersoll & Rooney PC

(57) ABSTRACT

A handheld litter disposal device for temporarily storing and containing cigarette ash, butts, and other litter. The litter disposal device includes a cap, a storage system, a pivot system adapted to permit the cap to move between the closed and open positions, and an extinguishing system containable within the storage system and adapted to extinguish the lit end of a cigarette. In the open position, ashes, butts, and unused portions of cigarettes, cigars, and/or other similar products can be transported from the outside to the inside of the litter disposal device and vice versa. In the closed position, however, cigarette ash and butts cannot enter or exit the storage system of the litter disposal device. The storage system has a rounded bottom or outer surface to prevent the litter disposal device from maintaining an upright position.

19 Claims, 14 Drawing Sheets

LITTER DISPOSAL DEVICE

CROSS-REFERENCE TO RELATED APPLICATION

This application claims priority to U.S. Patent Provisional Application No. 60/692,379, filed Jun. 21, 2005, which is incorporated herein by this reference in its entirety.

BACKGROUND

On the occasions when an individual desires to smoke, the individual typically must remain in a designate area outside. These designated outside areas do not always provide ashtrays or ash containers for proper disposal of cigarette ash, cigarette butts, and other litter. Individuals, therefore, are forced into the objectionable practice of allowing litter, ashes, and cigarette butts to pollute the ground and thus the environment.

When not properly extinguished, cigarette butts can become fire hazards. Partially lit cigarette butts can ignite grass or debris, resulting in a larger and more serious fire that could lead to injury or even death. In addition, the lack of proper ashtrays and ash containers within designated smoking areas can also increase the probability that discarded ash and cigarette butts are not adequately extinguished.

Ashtrays and ash containers are limited in portability and, therefore, must remain in a more permanent location, such as within an automobile or on a table. These ashtrays and ash containers are aesthetically unpleasing and are often considered undesirable. Accordingly, smokers are provided with fewer opportunities to dispose of litter, ash, and cigarette butts.

What is needed is a litter disposal device for temporarily containing and storing cigarette ash and butts and other litter, while preventing an individual from using the litter disposal device in a particular location for an extended period of time.

BRIEF SUMMARY

In accordance with one embodiment, a handheld litter disposal device comprises: a cap; a storage system for storing cigarette ashes and butts, the storage system having a storage body comprising an upper open end, a lower closed end having a rounded outer surface, and a peripheral wall extending from the upper open end to the lower closed end and defining a hollow cavity above the lower closed end; and a pivot system adapted to permit the cap to move between a closed position and an open position.

In accordance with another embodiment, a handheld litter disposal device comprises: a cap; a storage system for storing cigarette ashes and butts, the storage system having a storage body comprising an upper open end, a lower closed end having a rounded outer surface, and a peripheral wall extending from the upper open end to the lower end and defining a hollow cavity above the lower closed end; and a removable extinguishing system comprising an upper open end, a lower open end, a peripheral wall extending from the upper open end to the lower open end, and a plate element positioned near the upper open end of the storage system, and adapted to extinguish a lit end of a cigarette before the cigarette is deposited within the storage system.

In accordance with a further embodiment, a litter disposal device comprises: a cap having an open position and a closed position; a storage system comprising: a storage body having an upper open end, a lower closed end having a rounded outer surface, and a peripheral wall extending from the upper open end to the lower closed end; and an inner body containable within the storage body, wherein the inner body is shaped similarly to the storage body and is adapted to maintain the shape of the storage body, while sealing the storage body with the cap, when in the closed position; an extinguishing system containable within the storage system and adapted to extinguish the lit end of a cigarette, wherein the extinguishing system further comprises a plate element, the plate element is containable within the storage body and positioned near an upper open end of the storage body; and a pivot system adapted to permit the cap to move between the closed and open positions.

DETAILED DESCRIPTION

Figure 1B:
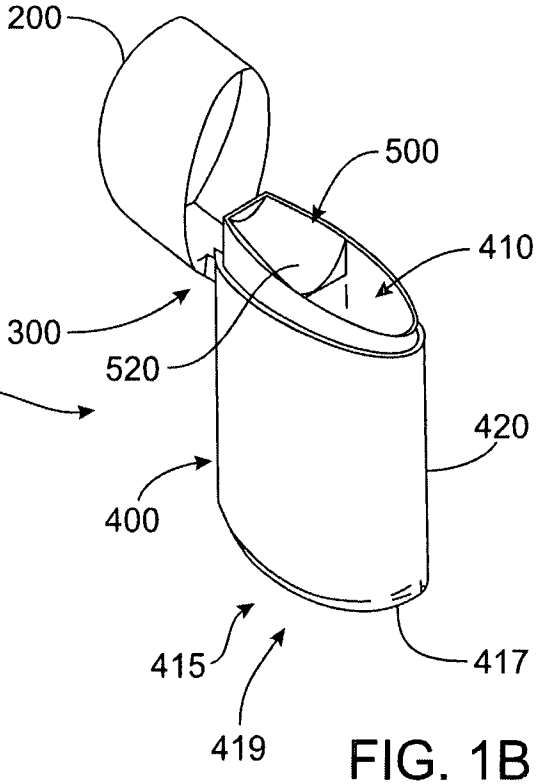
FIG. 1B shows a perspective view of a litter disposal device of FIG. 1A in an open position.
Figure 1A:
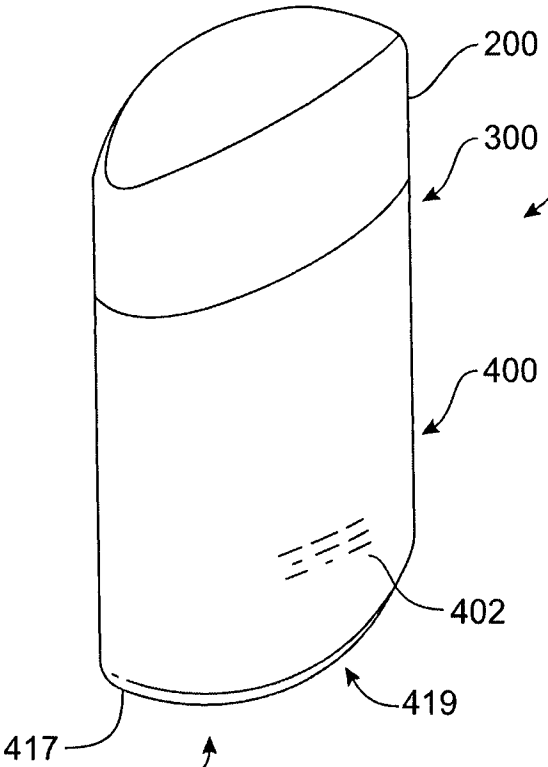
FIG. 1A shows a perspective view of a litter disposal device in a closed position in accordance with one embodiment.
Figure 1C:
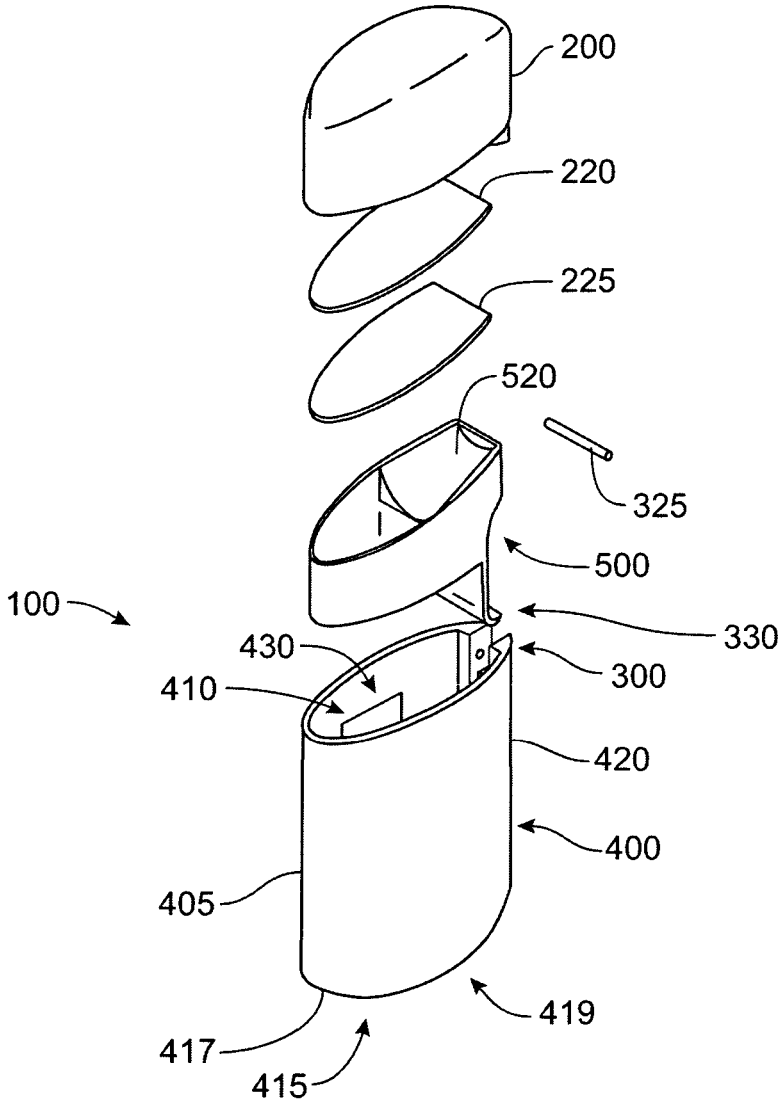
FIG. 1C shows an expanded view of the litter disposal device of FIG. 1B.

Referring now in detail to the drawing figures, wherein like reference numerals represent like parts throughout the several views, a handheld litter disposal device 100 (also referred to herein as "cigarette butt disposal device 100") of FIGS. 1A-1C is designed for proper disposal, storage, and containment of litter, ashes, butts, and unused portions of cigarettes, cigars, and/or other similar products (collectively referred to herein as "cigarette rubbish"). Further, the litter disposal device 100 is designed for portability and, therefore, allow for easy and convenient disposal of cigarette rubbish by an individual on the move. Although the litter disposal device 100 can be of various shapes and sizes, the litter disposal device 100 is preferably small enough to fit within a coat, shirt, or pant pocket.

When in an open position, as shown in FIG. 1B, the cigarette butt disposal device 100 is configured to permit the receipt of cigarette rubbish into the inside of the cigarette butt disposal device 100, while also permitting the expulsion of cigarette rubbish from the inside to the outside of the cigarette butt disposal device 100. The cigarette butt disposal device 100, however, prevents cigarette rubbish from entering or exiting the cigarette butt disposal device 100, when in a closed position as shown in FIG. 1A.

As shown in FIGS. 1A-1C, the cigarette butt disposal device 100 comprises a cap 200, a storage system 400, a pivot system 300, and an extinguishing system 500. The pivot system 300 is adapted to move the cap 200 between the open and closed positions. The extinguishing system 500 is containable within the storage system 400, such that the extinguishing system 500 is adapted to extinguish a cigarette (not shown) before being disposed within the storage system 500. Further, an extinguishing plate element 520 can be used to knock off ashes from the end of a cigarette into the storage system. One skilled in the art will recognize that the storage system 400 and extinguishing system 500 are generally constructed of non-flammable, heat-resistant materials.

The storage system 400 comprises an upper open end 410, such that the upper open end 410 is in communication with an inside and an outside of the cigarette butt disposal device 100 when the cap 200 is in the open position. Accordingly, cigarette rubbish can be received by the storage system 400 or removed from the storage system 400, when the cap 200 is in the open position. When the cap 200 is in the closed position, however, the upper open end 410 of the storage system 400 is not in communication with the outside of the cigarette butt disposal device 100. The cigarette rubbish, therefore, cannot enter or exit the storage system 400 when the cap 200 is in the closed position.

The pivot system 300 of the cigarette butt disposal device 100 comprises a pivot latch element 330 adapted to temporarily maintain the cap 200 in the closed position. The pivot latch element 330 is designed to ensure that the cigarette rubbish stored within the storage system 400 does not accidentally exit the storage system 400 at an inappropriate time. More particularly, the pivot latch element 330 provides significant resistance when an opening force is applied to the cap 200.

The storage system 400 further comprises a rounded bottom 419, such that the rounded bottom 419 is adapted to prevent the storage system 400 from maintaining an upright position if placed on a horizontal surface. In one embodiment, the cigarette butt disposal device 100 is designed to prevent an individual from placing the cigarette butt disposal device 100 on a flat surface, such as a table, during use. The cigarette butt disposal system 100 is intended to be portable, not stationary. Accordingly, the rounded bottom 419 of the storage system 400 prevents the cigarette butt disposal device 100 from being used as an ordinary ashtray. One of the advantages of having a storage system 400 with a rounded bottom 419 includes preventing an individual from using the cigarette butt disposal device 100 in one particular place for an extended period.

More specifically, the cigarette butt disposal device 100, as shown in FIGS. 1A-1C, comprises a cap 200, a storage body 405 adapted to store and contain cigarette rubbish, a pivot system 300 adapted to permit the cap to move between the closed and open positions, and an extinguishing system 500 containable within the storage body 405 and adapted to extinguish (or snuff) a cigarette. As an individual smokes, the cap 200 of the cigarette butt disposal device 100 can be moved to the open position, allowing ashes to be deposited within the storage body 405. Once the individual finishes smoking, the cigarette can be extinguished on the extinguishing system 500 and deposited within the storage body 405. The individual can then move the cap 200 to the closed position before putting the cigarette butt disposal device 100 in his or her pocket.

The cap 200 is adapted to move between an open and a closed position. As described above, the cap 200 prevents cigarette rubbish from entering or exiting the storage body 405 when the cap 200 is in the closed position. Conversely, the cap 200 allows the cigarette rubbish to be received into the storage body 405 for storage or expelled from the storage body 405 to the outside of the cigarette butt disposal device 100 for proper disposal.

One skilled in the art will recognize that the storage system 400 and extinguishing system 500 are preferably constructed of non-flammable, heat-resistant materials, such as zinc, stainless steel, brass, silver or other suitable non-flammable materials. The storage system 400 can also include an outer finish 402. The outer finish 402 can be any suitable finish including chrome, brushed chrome, brushed silver, satin, nickel, pearlized nickel, and/or a painted or colored finish. The storage system 400 can also include a design or inlay, including trademarks, aesthetically pleasing figures or shapes, such as orchids, flowers, or any other suitable marketing designs and configurations. In another embodiment, the litter device 100 can be partially or fully encased in a rubberized material.

Figure 2A:
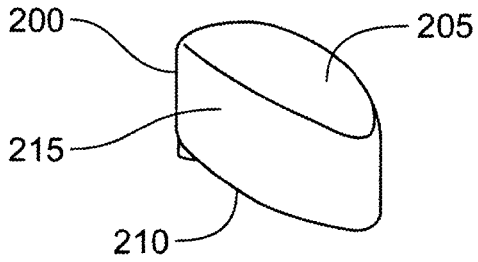
FIG. 2A shows a perspective view of a cap in accordance with another embodiment.
Figure 2B:
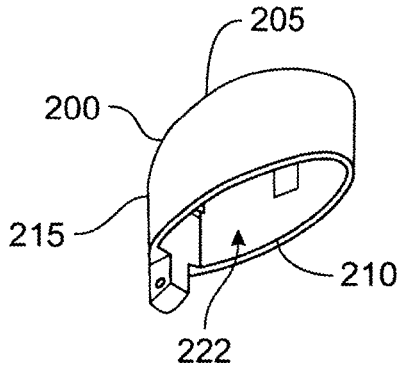
FIG. 2B shows a perspective view of the cap of FIG. 2A.

As shown in FIGS. 2A-2B, the cap 200 comprises an upper closed end 205, a lower open end 210, and a peripheral wall 215. The peripheral wall 215 extends downwardly from the upper closed end 205 to the lower open end 210, thereby defining a cavity 222 below the upper closed end 205 of the cap 200. Further, the lower open end 210 is adapted to engage an upper open end 410 of the storage body 405, when the cap 200 is in the closed position.

In one embodiment, the cap 200 further comprises an upper insert plate 220 and a lower insert plate 225, such that both the upper insert plate 220 and the lower insert plate 225 are containable within the cap 200. As shown in FIG. 1C, the upper insert plate 220 and the lower insert plate 225 are similarly shaped as the upper closed end 205 and the lower open end 210 of the cap 200. The upper insert plate 220 and the lower insert plate 225 maintain the shape of the cap 200 and provide a sealant between the cap 200 and the storage body 405. Generally, the lower insert plate 225 is made of ethylene vinyl acetate (EVA) foam or rubber to provide a sealant with the storage body 405. Accordingly, the upper insert plate 220 and the lower insert plate 225 prevent any unwanted spills from occurring. Alternatively, the upper insert plate 220 and the lower insert plate 225 absorb and dissipate the heat within the storage body 405, such that the upper closed end 205 of the cap 200 remains below a predetermined temperature. In other words, the upper insert plate 220 and the lower insert plate 225 prevent the upper closed end 205 of the cap 200 from becoming too hot.

Figure 3:
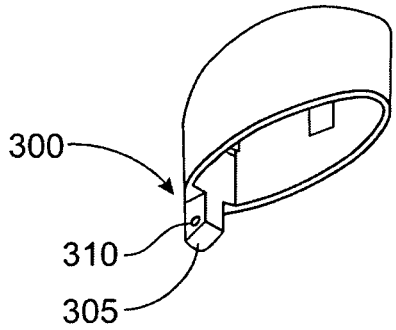
FIG. 3 shows a perspective view of the cap of a pivot system in accordance with a further embodiment.
Figure 4:
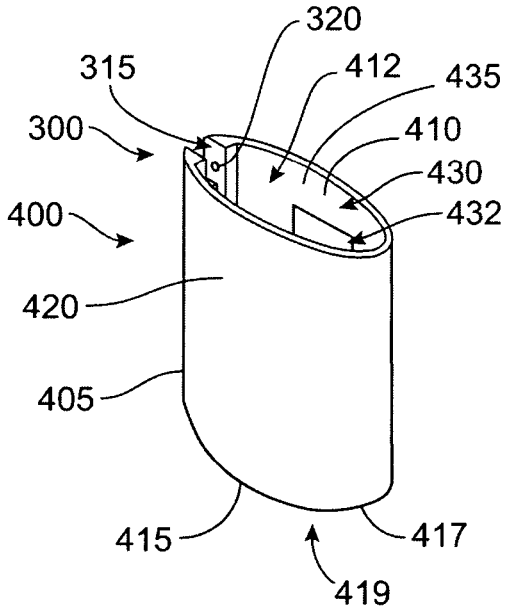
FIG. 4 shows a perspective view of a storage system and the pivot system in accordance with another embodiment.

The pivot system 300, as shown in FIGS. 3 and 4, is adapted to permit the cap 200 to move between the open and closed positions. The pivot system 300 comprises a pivot lug element 305 and a pivot groove element 315. The pivot lug element 305 is part of the cap 200, such that the pivot lug element 305 extends downwardly from a proximal end of the lower open end 210 of the cap 200. The pivot groove element 315 is part of the storage body 405, such that the pivot groove element 315 extends downwardly from a proximal end of the upper open end 410 of the storage body 405. Further, the pivot groove element 315 is adapted to receive the pivot lug element 305. The pivot lug element 305 and the pivot groove element 315 are formed to define a pivot lug aperture 310 and a pivot groove aperture 320, respectfully.

The pivot lug aperture 310 and the pivot groove aperture 320 are typically horizontally aligned within the pivot lug element 305 and the pivot groove element 315. When the pivot lug element 305 properly engages the pivot groove element 315, the pivot lug aperture 310 and the pivot groove aperture 320 are adequately aligned, such that a pivot hinge element 325, as shown in FIG. 1C, can be slideably contained therein. Accordingly, the pivot hinge element 325 connects the cap 200 with the storage body 405. Preferably, the pivot hinge element 325 is a hinge pin, although one skilled in the art will recognize that the pivot hinge element 325 can comprise other appropriate hinge devices. The cap 200 can then rotationally move between the open position and the closed position, wherein the lower open end 210 of the cap 200 engages with the upper open end 410 of the storage body 405, when the cap 200 is in the closed position. The rotational movement of the cap 200 can further be described as a rotational pivot at the proximal end of the cap 200 and storage body 405.

FIG. 4 shows a perspective view of a storage system 400 and the pivot system 300 in accordance with another embodiment. As shown in FIG. 4, the storage body 405 is adapted to temporarily store and contain cigarette rubbish, until the cigarette rubbish can be disposed of properly (e.g., into a standard ashtray or garbage container). Besides the upper open end 410, the storage body 405 further comprises a lower closed end 415 and a peripheral wall 420. The peripheral wall 420 extends downwardly from the upper open end 410 to the lower closed end 415 and, thereby defines a hollow cavity 412 above the lower closed end 415. The lower closed end 415 includes a rounded outer surface 417, which forms the rounded bottom 419 of the storage system 400. Cigarette rubbish is stored within the formed hollow cavity 412 during use of the cigarette butt disposal device 100. The hollow cavity 412 can also include a ridge 430 protruding circumferentially from an inner surface 435 of the storage body 405 and adapted to receive the extinguishing element 500. The ridge 430 can be comprised of a single ridge 432, which extends circumferentially around the inner surface 435 of the storage body 405, or a plurality of raised members (not shown) on the inner surface 435 of the storage body 405, which extend longitudinally from the lower closed end 415 towards the open end 410 of the storage body and forming a plurality of protruding points upon which the extinguishing element 500 can be received within the storage body 405.

The lower closed end 410 of the storage body 405 preferably has a rounded outer surface 417 to prevent the storage body 405 from maintaining an upright position. However, it can be appreciated that the lower end 410 of the storage body 405 can be other suitable shapes and/or configurations, which are adapted to prevent the storage body 405 from maintaining an upright position. As described above, the cigarette butt disposal device 100 is not to be used as an ordinary ashtray and, therefore, is designed to prevent an individual from putting the cigarette butt disposal device 100 on a flat surface.

Figure 5A:
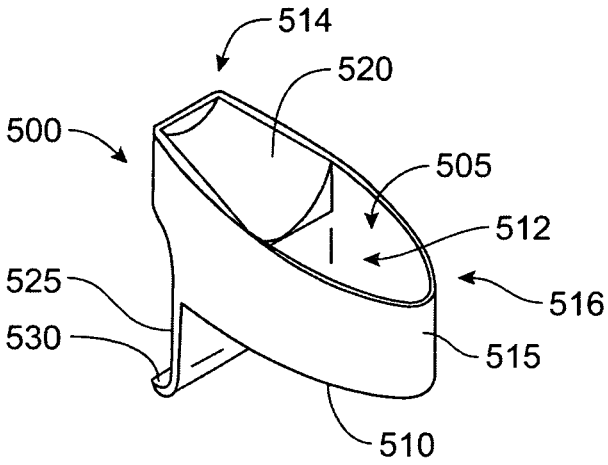
FIG. 5A shows a perspective view of an extinguishing system in accordance with a further embodiment.

FIG. 5A shows a perspective view of a removable extinguishing system 500 in accordance with a further embodiment. As shown in FIG. 5A, the extinguishing system 500 is adapted to engage and extinguish a cigarette, before the cigarette is deposited within the storage body 405. The extinguishing system 500 comprises an upper open end 505, a lower open end 510, a peripheral wall 515, and an extinguishing plate element 520. The peripheral wall 515 extends downwardly from the upper open end 505 to the lower open end 510, thereby forming a hollow interior 512 that permits the transport of cigarette rubbish from the outside of the storage body 405 to the inside of the storage body 405, or vice versa. The lower open end 510 of the extinguishing system 500 is adapted to engage the upper open end 410 of the storage body 405. More particularly, the extinguishing system 500 is partially containable within the storage body 405, such that the upper open end 505 of the extinguishing system 500 engages the lower open end 210 of the cap 200, when the cap 200 is in the closed position.

The extinguishing plate element 520 is in communication with the proximate end 514 of the upper open end 505 of the extinguishing system 500. The extinguishing plate element 520, therefore, narrows the passage between the inside and the outside of the storage body 405 by partially covering the upper open end 505 of the extinguishing system 500. Cigarette rubbish can only enter or exit the storage body 405 via the distal end 516 of the upper open end 505 of the extinguishing system 500, unless the extinguishing system 500 is actually removed from the storage body 405. When the lit end of the cigarette engages the extinguishing plate element 520, ashes at the end of the cigarette can be knocked off into the storage body 405 or the cigarette can be extinguished or snuffed out. The extinguishing plate element 520 can be flat or slightly contoured as shown in FIG. 5A for adequately engaging with the lit end of a cigarette. Additionally, the extinguishing plate element 520 can be slanted to assist the ashes that have been knocked off the end of the cigarette to slide easily into the storage body 405.

Figure 5B:
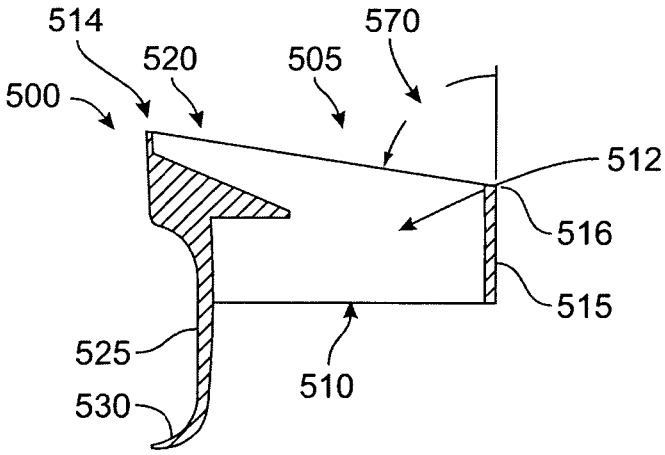
FIG. 5B shows a cross-sectional view of the extinguishing system of FIG. 5A.

FIG. 5B shows a cross-sectional view of the extinguishing system 500 of FIG. 5A. As shown in FIG. 5B, the extinguishing system 500 comprises an upper open end 505, a lower open end 510, a peripheral wall 515, and an extinguishing plate element 520. The peripheral wall 515 extends downwardly from the upper open end 505 to the lower open end 510, thereby forming the hollow interior 512 that permits the transport of cigarette rubbish from the outside of the storage body 405 to the inside of the storage body 405, or vice versa. As shown in FIG. 5B, the upper open end 505 and extinguishing plate 520 of the extinguishing system 500 can be slanted to assist the ashes that have been knocked off to slide easily into the storage body 405. However, it can be appreciated that the upper open end 505 and extinguishing plate 520 can also be relatively horizontal. The upper open end 505 preferably has an angle 570 of between about 60 to 90 degrees to the peripheral wall 515 as it extends downward, and more preferably about 75 to 85 degrees and most preferably about 80 degrees.

Figure 6B:
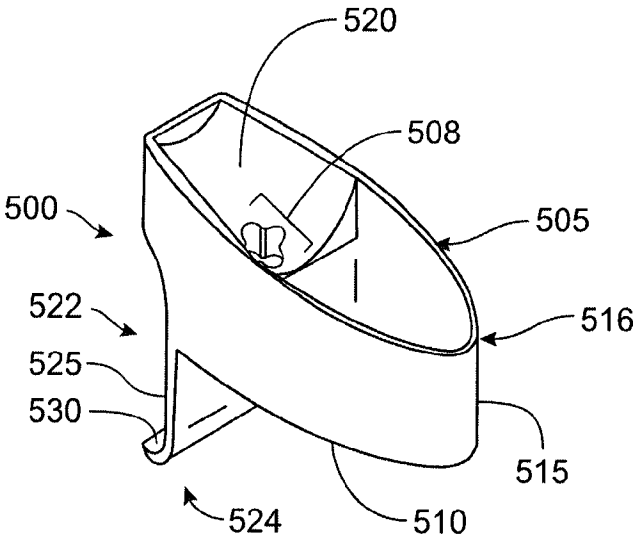
FIG. 6B shows a perspective view of the extinguishing system of FIG. 6A.
Figure 6A:
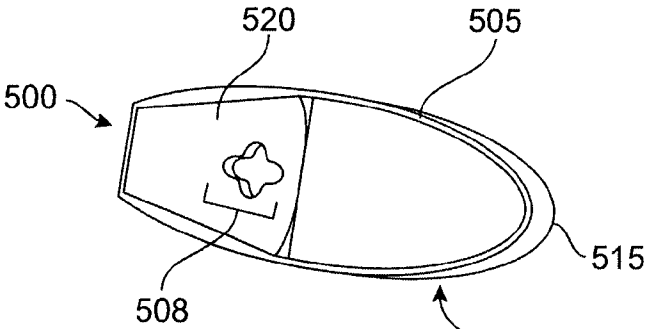
FIG. 6A shows a perspective view of another extinguishing system in accordance with another embodiment.
Figure 6C:
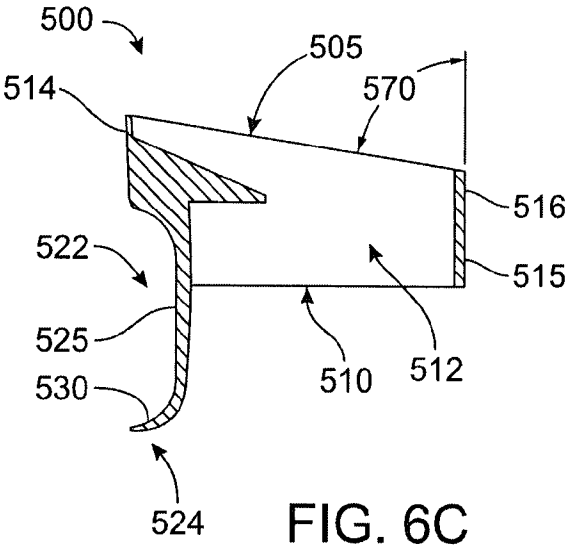
FIG. 6C shows a cross-sectional view of the extinguishing system of FIGS. 6A and 6B.

In another embodiment as shown in FIGS. 6A-6C, the extinguishing plate element 520 can further comprise an ash disposal slot 508, such that the ash disposal slot 508 is adapted to engage the lit end of a cigarette and assists the cigarette ashes to fall from the extinguishing plate element 520 into the storage body 405. The ash disposal slot 508 is configured to allow ashes from a cigarette to pass through the extinguishing plate element 520 into the storage body 405.

The ash disposal slot 508, therefore, is generally measured in size between 50% and 70% of the lit end of a cigarette. The ash disposal slot 508 can be configured in the shape of a plus sign or other suitable configurations.

The extinguishing system 500 further comprises an extinguishing handle element 525 that is in communication with the lower open end 510 of the extinguishing system 500. The extinguishing handle element 525 extends downwardly from the proximal end 522 of the lower open end 510. The extinguishing handle element 525 comprises an extinguishing lip element 530 in communication with the distal end 524 of the extinguishing handle element 525.

Figure 8A:
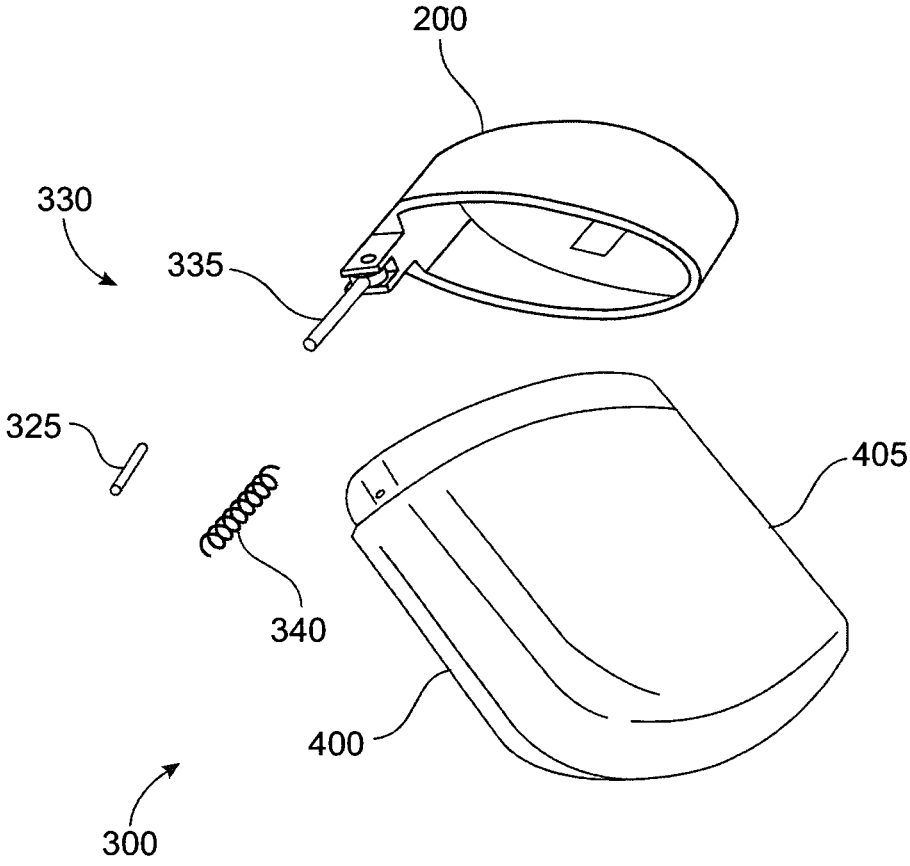
FIG. 8A shows a perspective view of a closing and locking mechanism of the litter disposal device in accordance with a further embodiment.
Figure 8B:
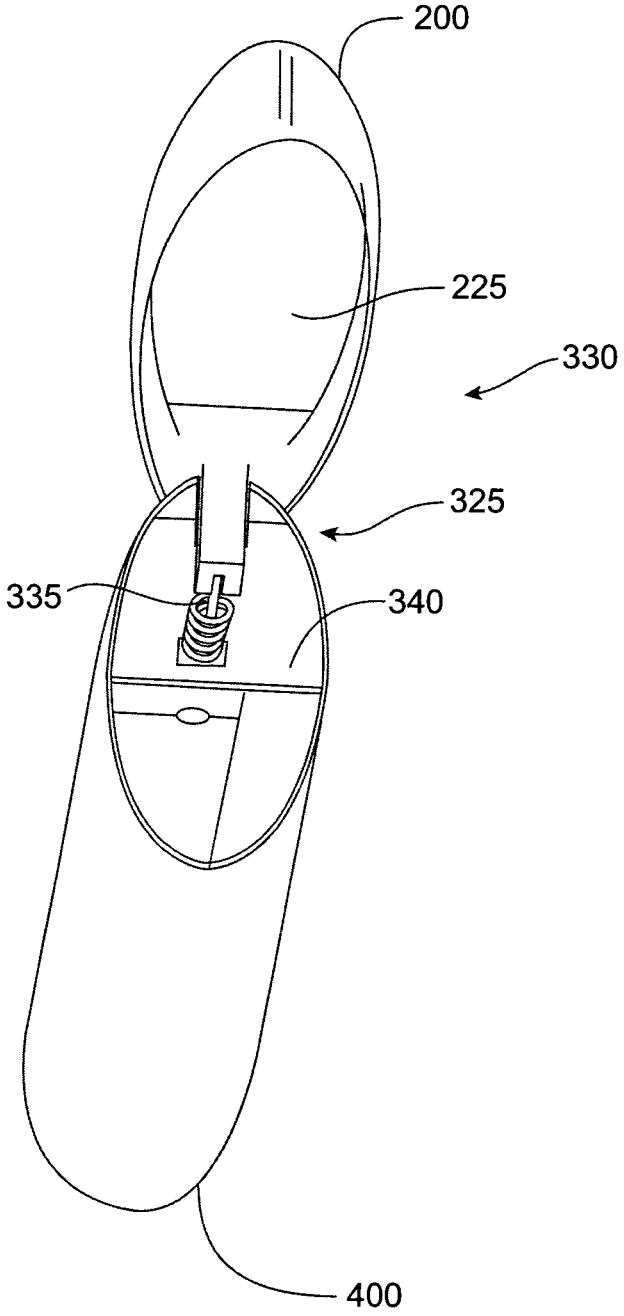
FIG. 8B shows a perspective view of the closing and locking mechanism of the litter disposal device of FIG. 8A.

When removed from the storage body 405, an individual can hold onto the extinguishing system 500 via the extinguishing handle element 525. The extinguishing handle element 525 is properly shaped so that an individual can easily hold the extinguishing system 500, while the cigarette rubbish within the storage body 405 is removed. The extinguishing lip element 530 provides the individual with a convenient location to put one's thumb while wrapping one's index finger around the extinguishing handle element 525. Further, the extinguishing lip element 530 is also adapted to position the extinguishing system 500 within the storage body 405 by engaging an inner side of the peripheral wall 420 of the storage body 405. As positioned, the extinguishing lip element 530 provides support to the extinguishing system 500 during use. In addition, the extinguishing handle 525 protects the pivot latch element 330 as shown in FIGS. 8A and 8B from the cigarette rubbish and/or ashes.

FIG. 6C shows a cross-sectional view of the extinguishing system 500 of FIGS. 6A and 6B. As shown in FIG. 6C, the extinguishing system 500 comprises an upper open end 505, a lower open end 510, a peripheral wall 515, an extinguishing plate element 520, and an ash disposal slot 508. The peripheral wall 515 extends downwardly from the upper open end 505 to the lower open end 510, thereby forming a hollow interior 512 that permits the transport of cigarette rubbish from the outside of the storage body 405 to the inside of the storage body 405, or vice versa.

Figure 7A:
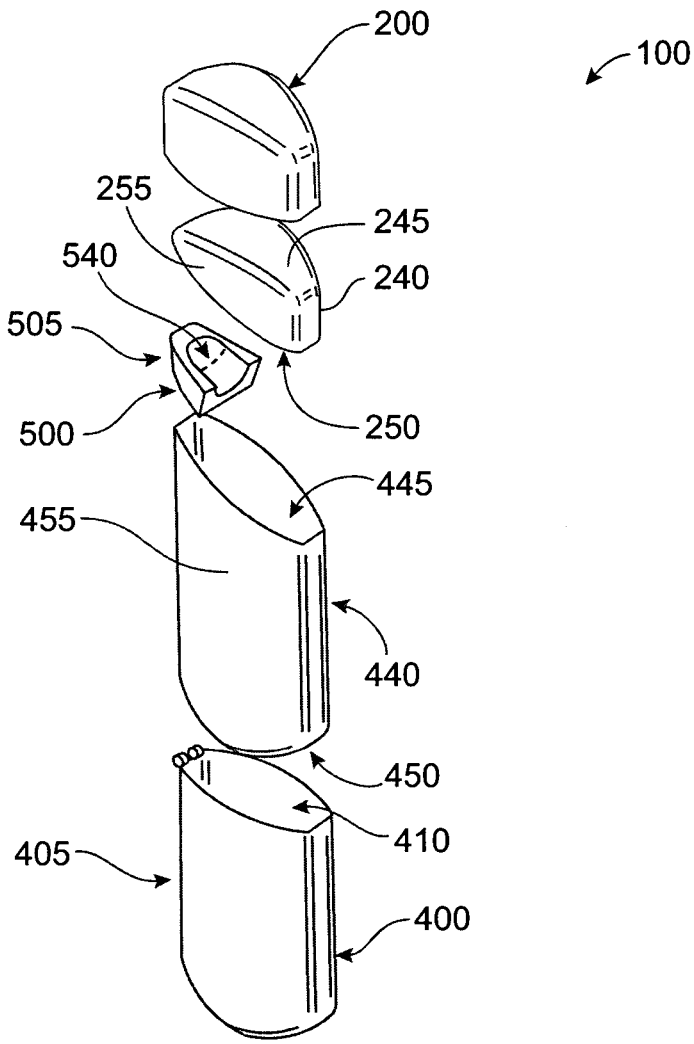
FIG. 7A shows an expanded view of a litter disposal device in accordance with another embodiment.

FIG. 7A shows an expanded view of a litter disposal device 100 in accordance with another embodiment. The cap 200 further comprises a cap inset element 240. The cap insert element 240 is containable within the cap 200 and is adapted to absorb and dissipate heat from the storage body 405. The cap insert element 240 can replace the upper insert plate 220 and the lower insert plate 225. More particularly, the cap insert element 240 comprises an upper closed end 245, a lower open end 250, and a peripheral wall 255. The peripheral wall 255 extends downwardly from the upper closed end 245 to the lower open end 250, thereby forming a hollow cavity below the upper closed end 245 of the cap insert element 240. The lower open end 250 of the cap insert element 240 is adapted to engage the upper open end 410 of the storage body 405.

Also, the storage body 405 can further comprise an inner body 440 containable within the storage body 405. The inner body 440 is adapted to store and contain cigarette rubbish, while absorbing and dissipating heat from the received cigarette rubbish. The inner body 440 comprises an upper open end 445, a lower closed end 450, and a peripheral wall 455. The shape of the inner body 440 is similar to the storage body 405, so that the inner body 440 can be slideably inserted into the storage body 405. The peripheral wall 455 extends downwardly from the upper open end 445 to the lower closed end 450 of the inner body 440, such that a hollow cavity is formed above the lower closed end 450, which is used for the containment and storage of cigarette rubbish. During use, the inner body 440 maintains the shape of the storage body 405 and provides a sealant between the storage body 405 and the cap 200. Alternatively, the inner body 440 prevents the storage body 405 from exceeding a predetermined temperature, thereby ensuring that the storage body 405 does not become too hot.

Additionally, the extinguishing system 500 can further comprise an extinguishing pocket 540 containable within the extinguishing system 500. More particularly, the extinguishing pocket 540 can be in communication with the proximal end of the upper open end 505 of the extinguishing system 500, thereby replacing the extinguishing plate element 520. Further, the extinguishing pocket 540 is adapted to engage and extinguish a cigarette, before it is deposited into the storage body 405. Similar to the extinguishing plate element 520, the extinguishing pocket 540 narrows the upper open end 505 of the extinguishing system 500. The extinguishing pocket 540 can be substantially curved to engage the lit end of a cigarette.

Figure 7B:
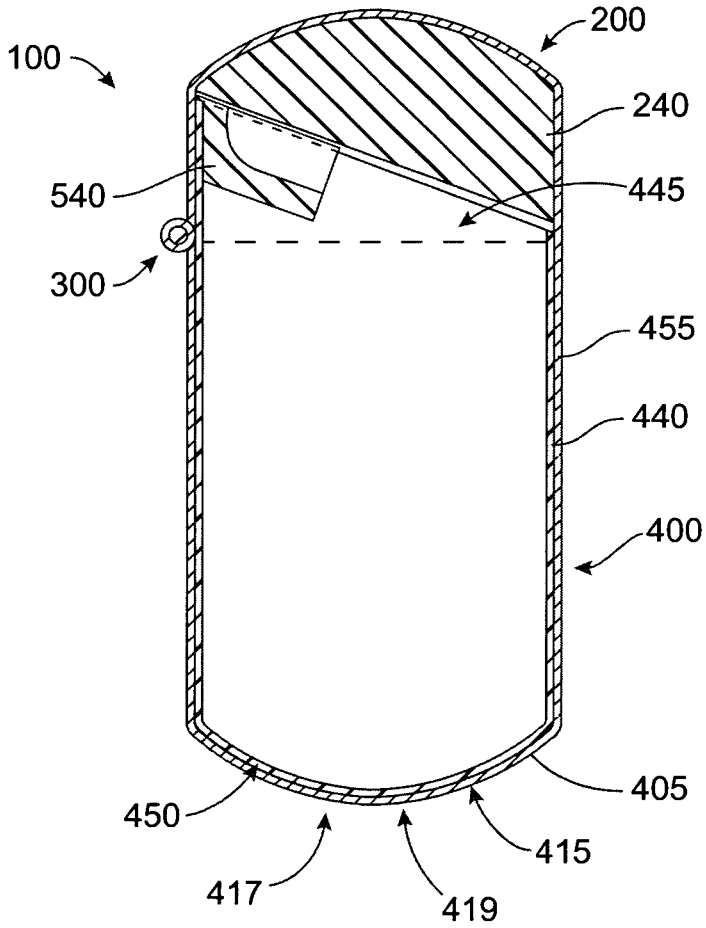
FIG. 7B shows a cross-sectional view of the litter disposal device of FIG. 7A.

FIG. 7B shows a cross-sectional view of the litter disposal device 100 of FIG. 7A. As shown in FIG. 7B, the litter disposal device 100 includes a cap inset element 240, and the storage body 405 includes an inner body 440 containable within the storage body 405. The cap insert element 240 is containable within the cap 200 and is adapted to absorb and dissipate heat from the storage body 405. The inner body 440 is adapted to store and contain cigarette rubbish, while absorbing and dissipating heat from the received cigarette rubbish. The inner body 440 comprises an upper open end 445, a lower closed end 450, and a peripheral wall 455. The shape of the inner body 440 is similar to the storage body 405, so that the inner body 440 can be slideably inserted into the storage body 405. The peripheral wall 455 extends downwardly from the upper open end 445 to the lower closed end 450 of the inner body 440, such that a hollow cavity is formed above the lower closed end 450, which is used for the containment and storage of cigarette rubbish. As shown in FIG. 7B, the storage bottom 405 includes a rounded bottom 419, such that the rounded bottom 419 is adapted to prevent the storage system 400 from maintaining an upright position.

FIGS. 8A and 8B show a closing and locking mechanism of the litter disposal device 100 in accordance with a further embodiment. As shown in FIGS. 8A-8B, the pivot system 300 can further comprise a pivot latch element 330, such that the pivot latch element 330 includes a bias element 340, such as a spring or a single pin spring action lever. The bias element 340 is adapted to temporarily maintain the cap 200 in the closed position. The bias element 340 is generally positioned at a proximate end of the cap 200 and the storage body 405. However, one skilled in the art will recognize that the bias element 340 can be effectively used to both hold the cap 200 in its open or closed positions. The bias element 340 generally biases the cap 200 to the closed position and provides an adequate amount of resistance to an opening force exerted upon the cap 200. Extending downwardly from the proximate end of the cap 200, the pivot lever 335 comprises two horizontally extending bar elements adapted to maintain the pivot lever 335 to the cap 200. The pivot lever 335 also engages the upper open end 410 of the storage body 405, thereby connecting the cap 200 to the storage body 405. When the cap 200 is in the closed position, the bias element 340 is in an energized state. When the cap 200 is in the open position, the bias element 340 is in a relaxed, non-energized state. As the pivot hinge element 325 engages the pivot lug element 305 and the pivot groove element 315, the bias element 340 and pivot lever 335 are securely positioned between the cap 200 and the storage body 405. As described above, the bias element 340 provides and adequate resistance to an opening force, thereby preventing the cap 200 from accidentally moving from the closed position to the open position.

In another embodiment, the pivot latch element 330 is adapted to temporarily maintain the cap 200 in the closed position. The pivot latch element 330 can be positioned at a distal end of the cap 200 and the storage body 405. However, one skilled in the art will recognize that the pivot latch element 330 can be effectively positioned in different locations within the cigarette butt disposal device 100. As described above, the pivot latch element 330 provides an adequate resistance to an opening force, thereby preventing the cap 200 from accidentally being moved from the closed position to the open position. Consequently, the pivot latch element 330 prevents cigarette rubbish from exiting the storage body 405 at an inappropriate time (e.g., while still in the pocket of the individual).

Figure 9B:
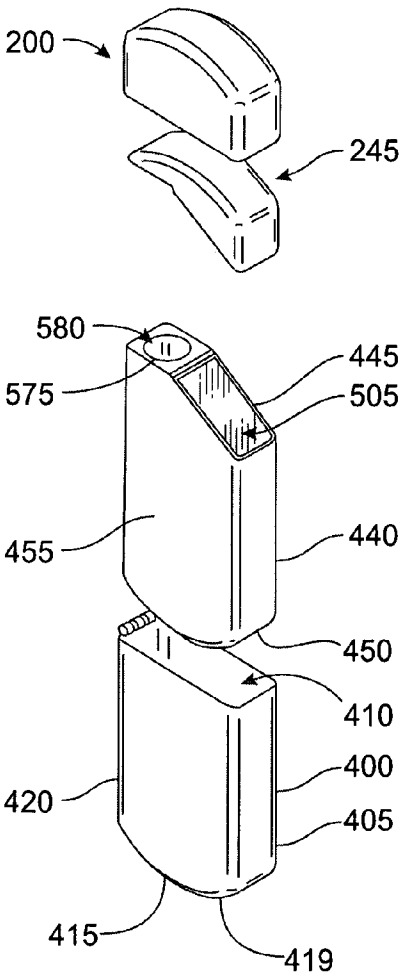
FIG. 9B shows an expanded view of the litter disposal device of FIG. 9A.
Figure 9A:
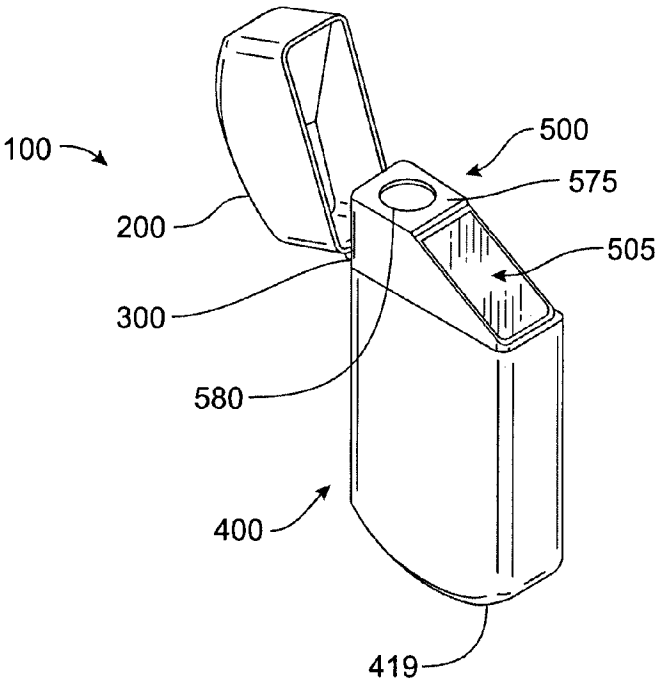
FIG. 9A shows a perspective view of a litter disposal device in an open position in accordance with a further embodiment.

FIG. 9A shows a perspective view of a litter disposal device 100 in an open position in accordance with a further embodiment. As shown in FIG. 9A, the litter disposal device 100 comprises a cap 200, a storage system 400, a pivot system 300, and an extinguishing system 500 having an upper plate 575 with a circular extinguishing pocket or cavity 580. The pivot system 300 is adapted to move the cap 200 between the open and closed positions. The extinguishing system 500 is containable within the storage system 400, such that the extinguishing system 500 is adapted to extinguish a cigarette before being disposed within the storage system 500 for proper storage.

The storage system 400 comprises an upper open end 410, such that the upper open end 410 is in communication with an inside and an outside of the cigarette butt disposal device 100 when the cap 200 is in the open position. Accordingly, cigarette rubbish can be received by the storage system 400 or removed from the storage system 400, when the cap 200 is in the open position. When the cap 200 is in the closed position, however, the upper open end 410 of the storage system 400 is not in communication with the outside of the cigarette butt disposal device 100. The cigarette rubbish, therefore, cannot enter or exit the storage system 400 when the cap 200 is in the closed position.

FIG. 9B shows an expanded view of the litter disposal device 100 of FIG. 9A in accordance with one embodiment. As shown in FIG. 9B, the cap 200 comprises a cap inset element 240. The cap insert element 240 is containable within the cap 200 and is adapted to absorb and dissipate heat from the storage body 405. The cap insert element 240 can replace the upper insert plate 220 and the lower insert plate 225. More particularly, the cap insert element 240 comprises an upper closed end 245, a lower open end 250, and a peripheral wall 255. The peripheral wall 255 extends downwardly from the upper closed end 245 to the lower open end 250, thereby forming a hollow cavity (not shown) below the upper closed end 245 of the cap insert element 240. The lower open end 250 of the cap insert element 240 is adapted to properly engage the upper open end 410 of the storage body 405.

Also, the storage body 405 can further comprise an inner body 440 containable within the storage body 405. The inner body 440 is adapted to store and contain cigarette rubbish, while absorbing and dissipating heat from the received cigarette rubbish. The inner body 440 comprises an upper open end 445, a lower closed end 450, and a peripheral wall 455. The shape of the inner body 440 is similar to the storage body 405, so that the inner body 440 can be slideably inserted into the storage body 405. The peripheral wall 455 extends downwardly from the upper open end 445 to the lower closed end 450 of the inner body 440, such that a hollow cavity is formed above the lower closed end 450, which is used for the containment and storage of cigarette rubbish. During use, the inner body 440 maintains the shape of the storage body 405 and provides a sealant between the storage body 405 and the cap 200. Alternatively, the inner body 440 prevents the storage body 405 from exceeding a predetermined temperature, thereby ensuring that the storage body 405 does not become too hot.

Additionally, the extinguishing system 500 can further comprise an upper plate 575 with a circular extinguishing pocket 580 containable within the extinguishing system 500. More particularly, the upper plate 575 with the circular extinguishing pocket or cavity 580 can be in communication with the proximal end of the upper open end 505 of the extinguishing system 500, thereby replacing the extinguishing plate element 520. The upper plate 575 having a circular extinguishing pocket 580 is adapted to engage and extinguish a cigarette, before it is deposited into the storage body 405. Similar to the extinguishing plate element 520, the circular extinguishing pocket 580 narrows the upper open end 505 of the extinguishing system 500.

Figure 9E:
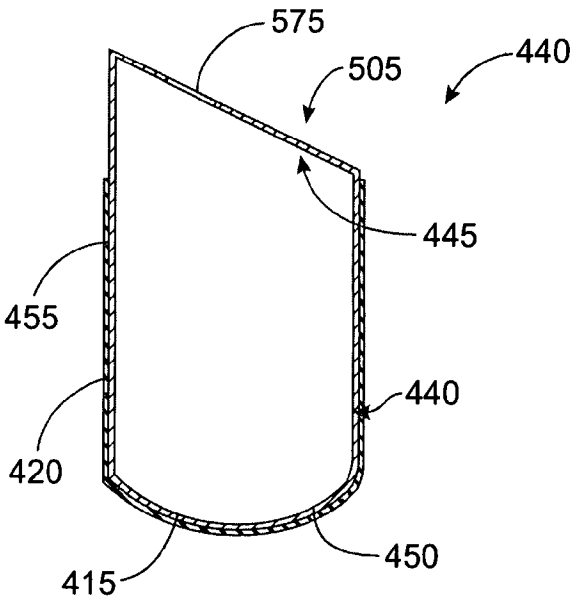
FIG. 9E shows a cross-sectional view of a storage system of FIG. 9A in accordance with another embodiment.
Figure 9D:
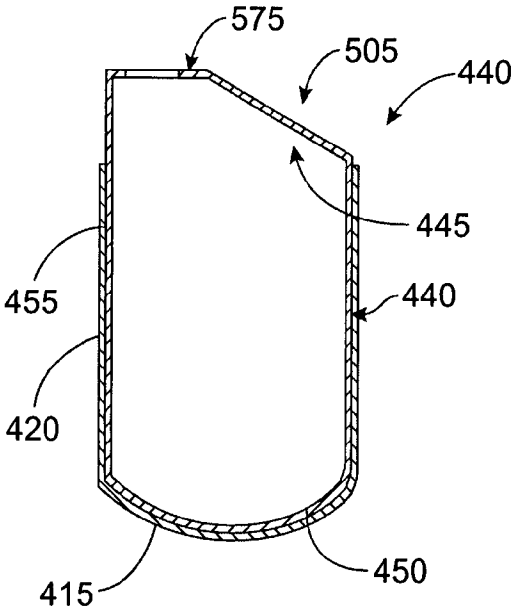
FIG. 9D shows a cross-sectional view of a storage system of the litter disposal device of FIG. 9A
Figure 9C:
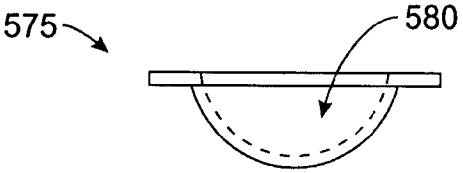
FIG. 9C shows a cross-sectional view of an extinguishing system of the litter disposal device of FIG. 9A.

FIG. 9C shows a cross-sectional view of the upper plate 575 having a circular extinguishing pocket 580 of FIG. 9A in accordance with another embodiment. As shown in FIG. 9C, the upper plate 575 includes the circular extinguishing pocket or cavity 580.

FIG. 9D shows a cross-sectional view of a storage system 400 of FIG. 9A in accordance with a further embodiment. As shown in FIG. 9D, the storage body 405 can further include an inner body 440 containable within the storage body 405. The shape of the inner body 440 is similar to the storage body 405, so that the inner body 440 can be slideably inserted into the storage body 405. The peripheral wall 455 extends downwardly from the upper open end 445 to the lower closed end 450 of the inner body 440 forming a hollow cavity above the lower closed end 450, which is used for the containment and storage of cigarette rubbish. In addition, the extinguishing system 500 includes an upper plate 575 with a circular extinguishing pocket or cavity 580. As shown in FIG. 9D the upper plate 575 and the upper open end 445 of the inner body 440 are at an angle to one another with the upper plate 575.

FIG. 9E shows a cross-sectional view of a storage system 400 of FIG. 9A in accordance with another embodiment. As shown in FIG. 9E, the extinguishing system 500 includes the upper plate 575 with a circular extinguishing pocket 580, which is in the same plane as the upper open end 445 of the inner body 440.

Figure 10A:
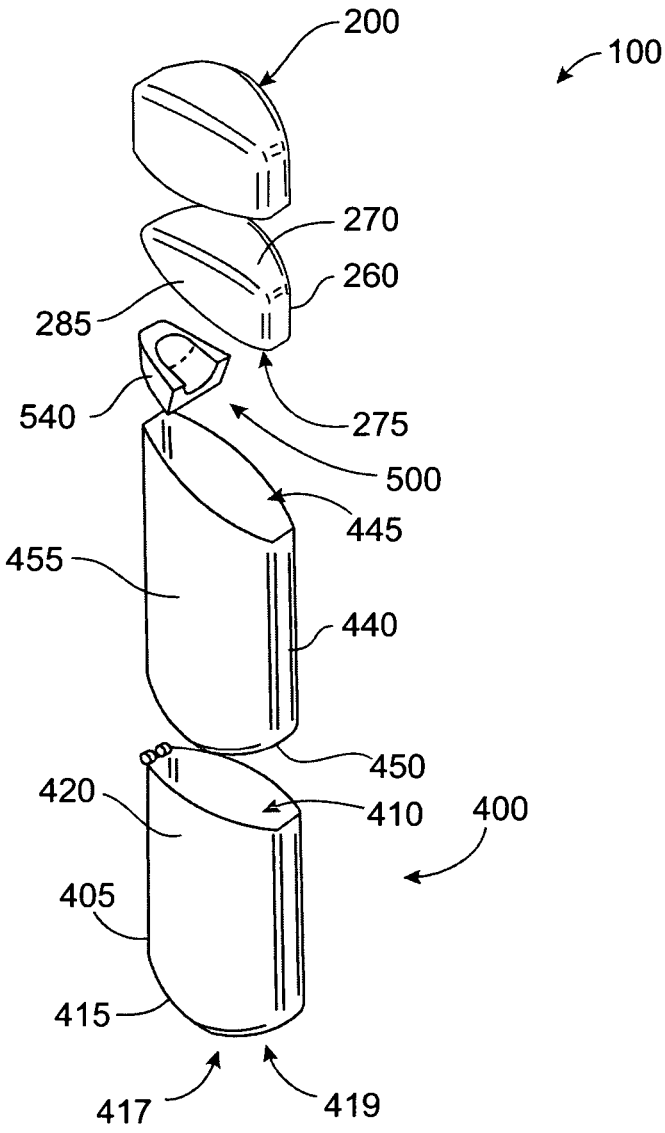
FIG. 10A shows an expanded view of a litter disposal device in accordance with a further embodiment.

FIG. 10A shows an expanded view of a litter disposal device 100 in accordance with a further embodiment. As shown in FIG. 10A, the cap 200 further comprises a carbon assembly 260, which is containable within the cap 200 and is adapted to reduce odor by absorbing odor from the storage body 405. The carbon assembly 260 includes a removable or replaceable carbon insert or cartridge 265 (FIG. 10C). It can be appreciated that the carbon insert or cartridge 265 does not necessarily need to contain a carbon material and that any suitable odor reducing material can be used instead of carbon. The carbon assembly 260 includes an upper closed end 270, a lower plate 275 having a plurality of perforations 280 (FIG. 10B), and a peripheral wall 285. The peripheral wall 285 extends downwardly from the upper closed end 270 to the lower plate 275, thereby forming a hollow cavity 267 (FIG. 10C) below the upper closed end 270 of the carbon assembly 260. The hollow cavity 267 is adapted to receive a replaceable carbon insert or cartridge 265. The lower plate 275 of the carbon assembly 260 is preferably adapted to engage the upper open end 410 of the storage body 405.

Figure 10B:
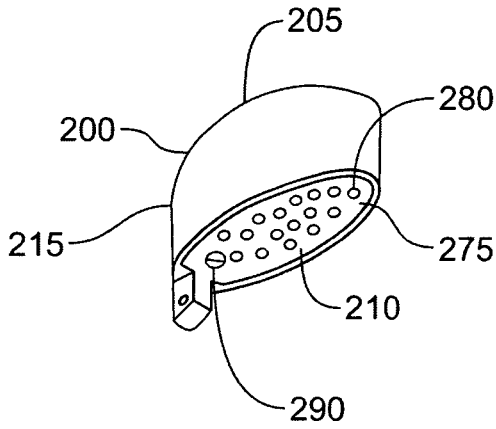
FIG. 10B shows a perspective view of the cap of FIG. 10A with a carbon assembly.
Figure 10C:
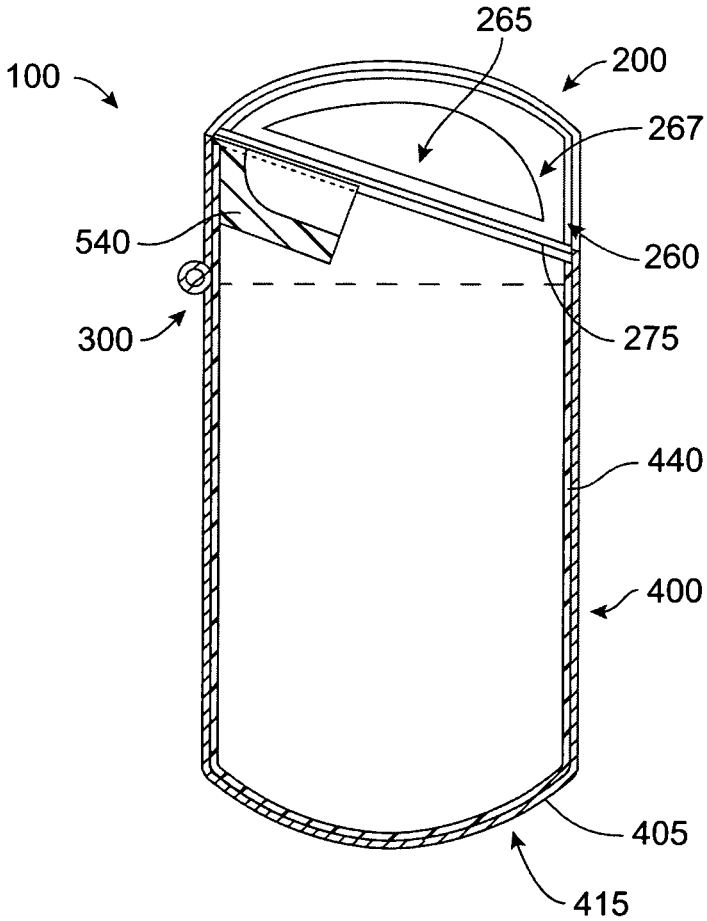
FIG. 10C shows a cross-sectional view of the litter disposal device of FIG. 10A with a cap having a carbon assembly.

FIG. 10B shows a perspective view of the cap 200 of FIG. 10A with a carbon assembly 260. As shown in FIG. 10B, the carbon assembly 260 is adapted to fit within the cap 200 and includes a lower plate 275 having a plurality of perforations 280, and a screw 290 or other suitable connection means to allow the carbon insert or cartridge 275 to be replaced. The carbon insert or cartridge 265 is adapted to fit within the hollow cavity between the upper closed end 270 and the lower plate 275. It can be appreciated that the cap 200 can be configured wherein the carbon insert or cartridge 275 is adapted to fit within the cavity 222 (FIG. 2B) and the lower plate 275 is adapted to fit within the cap 200.

FIG. 10C shows a cross-sectional view of the litter disposal device 100 of FIG. 10A with a cap 200 with a carbon assembly 260. As shown in FIG. 10C, the litter disposal device 100 includes a carbon assembly 260, and the storage body 405 includes an inner body 440 containable within the storage body 405. The carbon assembly 260 is containable within the cap 200 and is adapted to reduce and absorb odors from the storage body 405. The carbon assembly 260 includes a replaceable carbon cartridge or inserts 265, which is contained within the cavity 267 between the upper closed end 270 and the lower plate 275.

One skilled in the art will recognize that the cigarette butt disposal system 100, including the cap 200, pivot system 300, storage system 400, and extinguishing system 500, and all of the components and/or elements thereof can be made of a variety of suitable heat-resistant materials including, but not limited to, plastic, rubber, metal, ceramic, or other suitable materials or a combination thereof.

In addition, it can be appreciated that the litter disposal device 100 can be stored in a carrying case (not shown) worn on a belt of the smoker. The carrying case preferably includes a main body adapted to receive the litter disposal device 100, a closable flap, and a fastener, such as snap. The carrying case is preferably constructed of a sturdy, rigid material that protects the handheld device from damage, such as leather, a plastic like material or other suitable fabric. The carrying case can be attached to the user's belt by any suitable method, including a loop on the back of the carrying case, through which the belt is then fed, or a belt clip on the back of the carrying case.

Numerous characteristics and advantages have been set forth in the foregoing description, together with details of structure and function. It will be apparent to those skilled in the art that many modifications, additions, and deletions, especially in matters of shape, size, and arrangement of parts, can be made therein without departing from the spirit and scope and its equivalents as set forth in the following claims. Therefore, other modifications or embodiments as may be suggested by the teachings herein are particularly reserved as they fall within the breadth and scope of the claims here appended.

What is claimed is:

1. A handheld litter disposal device comprising:

a cap;

a storage system for storing cigarette ashes and butts, the storage system having a storage body comprising an upper open end, a lower closed end having a rounded outer peripheral surface adapted to prevent the storage system from maintaining an upright position when placed on a horizontal surface, and a peripheral wall extending from the upper open end to the lower closed end and defining a hollow cavity above the lower closed end;

a pivot system adapted to permit the cap to move between a closed position and an open position; and a removable extinguishing system comprising an upper open end, a lower open end, a peripheral wall extending from the upper open end to the lower open end, and an extinguishing plate element positioned near the upper open end of the storage system, and adapted to extinguish a lit end of a cigarette before the cigarette is deposited within the storage system.

2. The disposal device of claim 1, wherein the lower open end of the extinguishing system is adapted to engage the upper open end of the storage body.

3. The disposal device of claim 1, wherein the extinguishing system is partially containable within the storage body, such that the upper open end of the extinguishing system is containable within the cap, when the cap is in the closed position.

4. The disposal device of claim 1, wherein the extinguishing system further comprises an extinguishing handle element in communication with the lower open end of the extinguishing system.

5. The disposal device of claim 1, wherein the extinguishing plate element includes an ash disposal slot, wherein the ash disposal slot allows ashes from a cigarette to fall through the extinguishing plate element into the storage body.

6. The disposal device of claim 1, wherein the cap includes an upper insert plate and a lower insert plate, the lower insert plate forming a seal with the upper open end of the extinguishing system when the cap is in a closed position.

7. The disposal device of claim 1, wherein the cap includes a carbon assembly adapted to fit within the cap, the carbon assembly comprising a lower plate having a plurality of perforations, and a replaceable carbon insert.

8. The disposal device of claim 1, wherein the cap further includes a cap insert, the cap insert element comprising an upper closed end, a lower open end, and a peripheral wall, the peripheral wall extending downwardly from the upper closed end to the lower open end and forming a hollow cavity below the upper closed end of the cap insert element.

9. The disposal device of claim 1, further comprising an inner body adapted to be received within the storage body, the inner body having an upper open end, a lower closed end and a peripheral wall extending from the upper open end to the lower closed end.

10. The disposal device of claim 1, wherein the pivot system comprises a latch adapted to maintain the cap in the closed position.

11. A handheld litter disposal device comprising:

a cap;

a storage system for storing cigarette ashes and butts, the storage system having a storage body comprising an upper open end, a lower closed end having a rounded lowermost outer surface adapted to prevent the storage system from maintaining an upright position when placed on a horizontal surface, and a peripheral wall extending from the upper open end to the lower end and defining a hollow cavity above the lower closed end; and a removable extinguishing system comprising an upper open end, a lower open end, a peripheral wall extending from the upper open end to the lower end, and an extinguishing plate element positioned near the upper open end of the storage system, and adapted to extinguish a lit end of a cigarette before the cigarette is deposited within the storage system.

12. The disposal device of claim 11, wherein the lower open end of the extinguishing system is adapted to engage the upper open end of the storage body.

13. The disposal device of claim 11, wherein the cap includes at least one insert plate adapted to absorb and/or dissipate heat within the storage body such that the cap remains below a predetermined temperature.

14. The disposal device of claim 11, wherein the cap includes a carbon assembly adapted to fit within the cap, the carbon assembly comprising a lower plate having a plurality of perforations, and a replaceable carbon insert.

15. The disposal device of claim 11, wherein the cap further includes a cap insert, the cap insert element comprising an upper closed end, a lower open end, and a peripheral wall, the peripheral wall extending downwardly from the upper closed end to the lower open end and forming a hollow cavity below the upper closed end of the cap insert element.

16. The disposal device of claim 13, wherein the extinguishing system is partially containable within the storage body, such that the upper open end of the extinguishing system engages the lower insert plate of the cap, when the cap is in the closed position.

17. A litter disposal device comprising:

a cap having an open position and a closed position;

a storage system comprising:

a storage body having an upper open end, a lower closed end having a rounded lowermost surface adapted to prevent the storage system from maintaining an upright position when placed on a horizontal surface, and a peripheral wall extending from the upper open end to the lower closed end; and an inner body containable within the storage body, wherein the inner body is shaped similarly to the storage body and is adapted to maintain the shape of the storage body, while sealing the storage body with the cap, when in the closed position;

an extinguishing system containable within the storage system and adapted to extinguish the lit end of a cigarette, wherein the extinguishing system further comprises an extinguishing plate element, the plate element is containable within the storage body and positioned near an upper open end of the storage body; and a pivot system adapted to permit the cap to move between the closed and open positions;

wherein the extinguishing system further includes an upper open end, a lower open end, a peripheral wall extending from the upper open end to the lower end, and the extinguishing plate element positioned near the upper open end of the storage system, and adapted to extinguish a lit end of a cigarette before the cigarette is deposited within the storage system.

18. The disposal device of claim 17, wherein the cap includes a carbon assembly adapted to fit within the cap, the carbon assembly comprising a lower plate having a plurality of perforations, and a replaceable carbon insert.

19. The disposal device of claim 17, wherein the cap further includes a cap insert, the cap insert element comprising an upper closed end, a lower open end, and a peripheral wall, the peripheral wall extending downwardly from the upper closed end to the lower open end and forming a hollow cavity below the upper closed end of the cap insert element.

* * * * *